US008219002B2

(12) United States Patent
Bonacci et al.

(10) Patent No.: US 8,219,002 B2
(45) Date of Patent: Jul. 10, 2012

(54) CONTROLLING SHEET SYNCHRONIZATION IN A DIGITAL PRINTING SYSTEM

(75) Inventors: Andrew J Bonacci, Webster, NY (US); Jonathan B Hunter, Marion, NY (US); David M Kerxhalli, Rochester, NY (US); David R Kretschmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/225,744

(22) Filed: Sep. 6, 2011

(65) Prior Publication Data

US 2011/0318041 A1 Dec. 29, 2011

Related U.S. Application Data

(63) Continuation of application No. 12/491,307, filed on Jun. 25, 2009, now abandoned.

(51) Int. Cl.
*G03G 21/14* (2006.01)

(52) U.S. Cl. ..... 399/160

(58) Field of Classification Search ..... 399/107, 399/160, 162, 167, 299, 301, 306, 396
See application file for complete search history.

(56) References Cited

U.S. PATENT DOCUMENTS

| | | | | |
|---|---|---|---|---|
| 4,025,180 | A * | 5/1977 | Kurita et al. | 399/92 |
| 4,922,305 | A * | 5/1990 | Agarwal | 399/343 |
| 5,101,232 | A * | 3/1992 | Evans et al. | 399/160 |
| 5,173,733 | A * | 12/1992 | Green | 399/26 |
| 5,541,708 | A * | 7/1996 | Tsuruoka | 399/60 |
| 5,966,572 | A * | 10/1999 | Mishra et al. | 399/160 |
| 7,519,314 | B2 | 4/2009 | Carolan | |
| 2006/0233569 | A1 * | 10/2006 | Furst et al. | 399/162 |

OTHER PUBLICATIONS

U.S. Appl. No. 12/388,101, filed Feb. 18, 2009 by Ana P. Tooker et al, "Controlling Sheet Registration in a Digital Printing System".

* cited by examiner

*Primary Examiner* — David Porta
*Assistant Examiner* — Marcus Taningco

(57) ABSTRACT

A calibration procedure for the synchronization of photoreceptor belt seams of tandem marking devices at system cycle-up. The procedure allows for images projected upon equivalent image panels relative to the belt seams of the tandem engines to be printed on the same sheet. The successive image panels on each belt are of relatively equal distance from the respective belt seams. Thus there is less frequency of the need to skip pitches in the printing operation to avoid either imaging on a belt seam or having the sheet arrive outside the input timing window for second engine sheet registration.

6 Claims, 2 Drawing Sheets

CONTROLLING SHEET SYNCHRONIZATION IN A DIGITAL PRINTING SYSTEM

CROSS-REFERENCE TO RELATED APPLICATIONS

Figure 1:
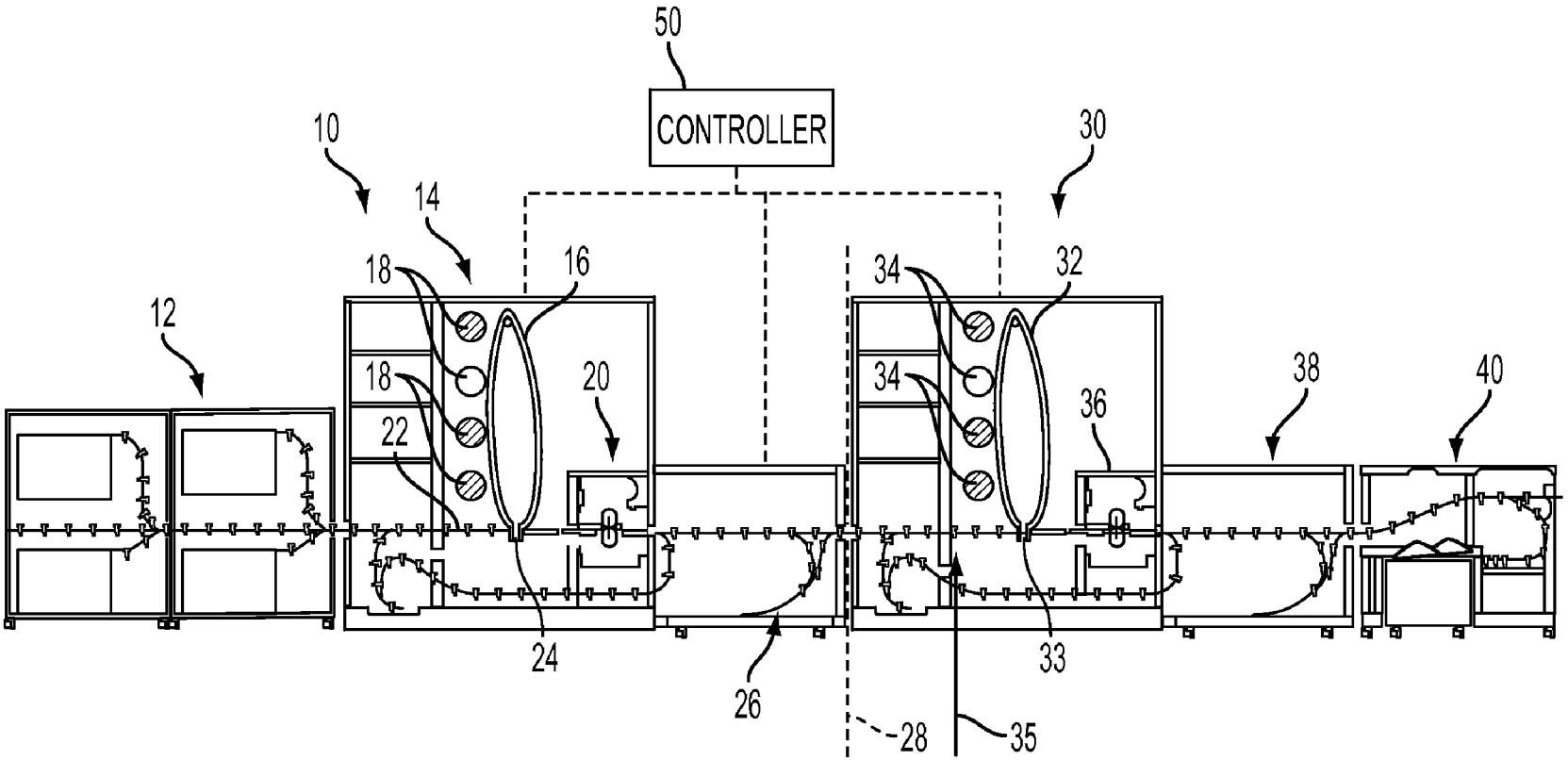

This is a continuation-in-part of U.S. application Ser. No. 12/491,307; filed Jun. 25, 2009, now abandoned, by the same inventors, and claims priority therefrom.

BACKGROUND

1. Field of the Technology

The present disclosure relates to digital printing systems having plural tandem marking or printing engines of the type with seamed photoreceptor (P/R) belts. In such printing systems, it is common practice to invert the sheet after marking on one side in a first printing engine and for feeding the inverted sheet into a second printing engine for marking on the opposite side of the sheet to thus facilitate high speed duplex digital printing. In printing systems having plural tandem engines using photoreceptor belts with seams, it is necessary to avoid imaging on belt seams. This requires some manner of skipping pitches, a pitch defined as the space on the belt for one image, in order to avoid either placing images on belt seams or having the sheet arrive outside the timing window for sheet registration in the second engine. However, skipping pitches adversely affects printer efficiency.

2. Description of the Prior Art

A general manner of belt synchronization to avoid seams, showing the control of the belt speed of the marking devices to synchronize belts, is disclosed in U.S. Pat. No. 7,519,314 B2, assigned to the same assignee as the present disclosure. However, this technique is relatively inefficient in relation to the present disclosure. It is also shown in pending U.S. application Ser. No. 12/388,101, filed Feb. 18, 2009, now Publication No. 20100209161 by Ana P. Tooker et al, "Controlling Sheet Registration In A Digital Printing System", to control sheet registration in a printing system by varying the dwell time of a sheet in an inverter in a first marking device and changing various transport motor speeds to time the arrival of the sheet at a second marking device. However, there is no disclosure of the need to synchronize the belts for efficient avoidance of belt seams for the productivity of the printing process. With the speeds of the two PR's no longer synchronized, the seam zones of said PR's are no longer in phase. With no understanding of the relative position of the two seam zones to each other, skipped pitches may occur in a non-optimal manner impacting customer productivity.

SUMMARY OF THE DISCLOSURE

This disclosure is a calibration or positional procedure for the synchronization of photoreceptor belt seams of tandem marking devices at system cycle-up. The procedure allows for images projected upon equivalent image panels relative to the belt seams of the tandem engines to be printed on the same sheet. Since the successive image panels on each belt are of relatively equal distance from the respective belt seam, there is less frequency of the need to skip pitches in the printing operation to avoid imaging on a belt seam.

Further features and advantages will be apparent to those skilled in the art from the specific apparatus and its operation or methods described in the example(s) below, and the claims.

Figure 2:
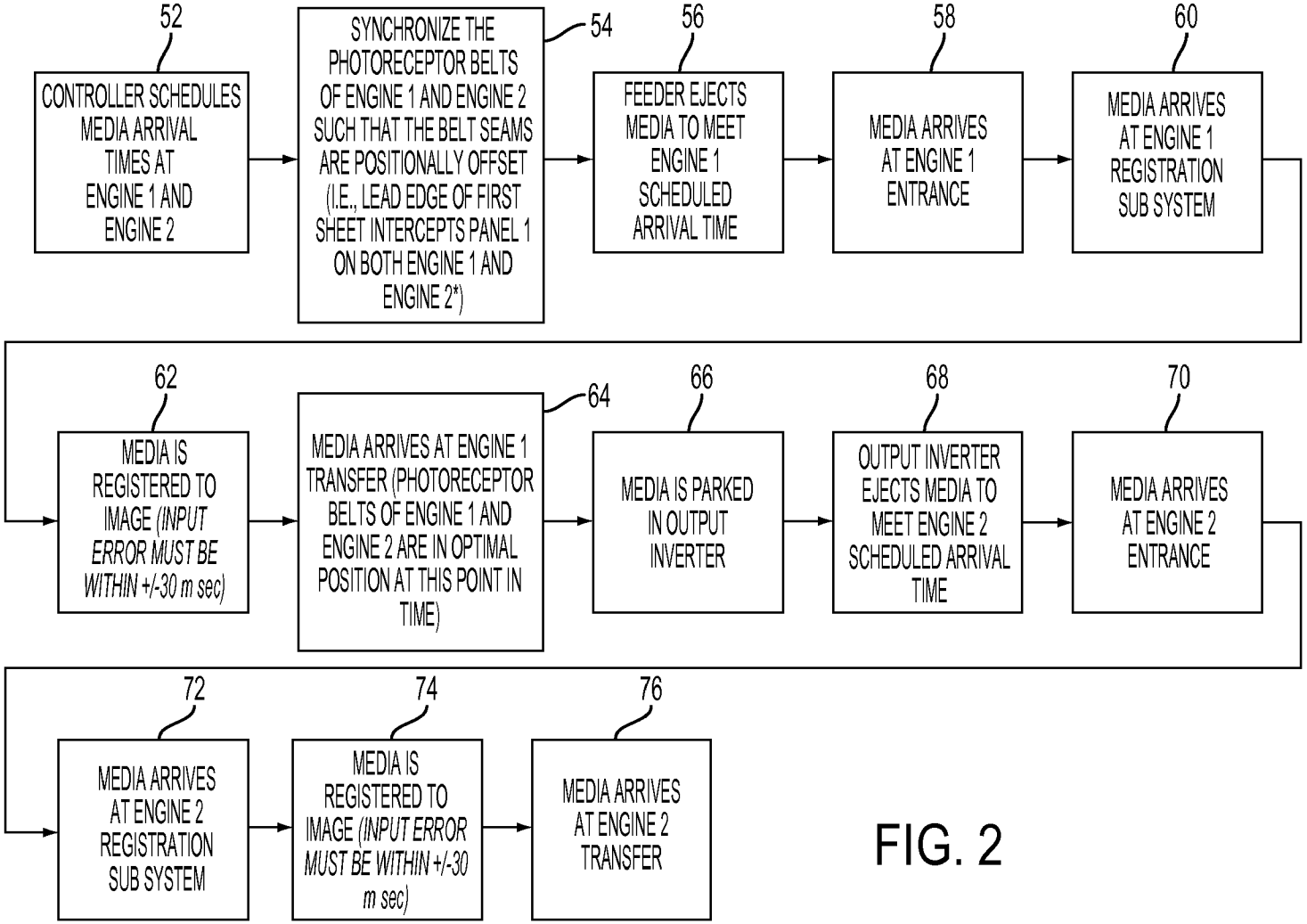

Thus, they will be better understood from this description of these specific embodiment(s), including the drawing figures wherein:

FIG. 1 is a schematic of an exemplary digital printing system having tandem marking engines; and FIG. 2 is a flow diagram of the method of belt synchronization in accordance with the present disclosure.

DETAILED DESCRIPTION OF DISCLOSURE

In accordance with the present disclosure, successive image panels on each photosensitive belt of the tandem engines in a printing system are of relatively equal distance from the respective belt seam of the photosensitive belt. In particular, the position of the belt seam of the second print engine in a tandem printing system relative to the belt seam of the first print engine is determined at system start-up. This allows for inverted sheets conveyed from the first print engine to the second print engine to be printed on the second side using an equivalent image panel (same location with respect to the belt seam of engine 2) as the location of the image panel with respect to the belt seam of engine 1 for printing on the first side.

As an example, in 10-pitch mode, where 10 image panels (locations) are defined around the circumference of the P/R belt, image panel #1 is defined as the panel immediately following the seam zone and image panel #10 as the panel immediately preceding the seam zone. An equivalent image panel is the same relative location of an image 1 in the first marking device from the seam of the first belt as the location of an image 2 in the second marking device from the seam of the second belt. That is, if an image panel used for printing on the first side of a sheet is the panel right after the seam, the first image panel used for printing on the second side of the same sheet in the second engine will also be the panel right after the seam of the second engine belt. By beginning the job with the belt positions in a known location, the time (and number of prints) before the first skipped pitch can be maximized. It should be noted, however, that the significance of the disclosure is that, whatever images are required for both sides of a sheet, it can be done by synchronizing a first image with respect to the seam of the first engine with a second image with respect to the seam of the second engine. It is not necessary for the images to be the same panel with respect to the seams. A significance of the disclosure is that there can be an arbitrary selection of panels, for example panel 1 of engine 1 and panel 5 of engine 2 could be selectively synchronized to place the image of panel 1 of engine 1 on a first side of a given sheet and the image of panel 5 of engine 2 on the opposite side of the same sheet. The only requirement would then be that the following images on panels are consistent with the originally selected panels.

With reference to FIG. 1, a digital printing system according to the present disclosure is indicated generally at 10 and includes a sheet feeder assembly indicated generally at 12, a first marking engine indicated generally at 14 including a P/R belt 16 and a plurality of colorant generators 18 for a color image formation on the belt 16. The marking engine 14 includes a fuser 20 and a transport path 22 through the marking engine. The P/R belt 16 is operative to transfer the image to the first side of sheet stock on path 22 at a transfer station indicated by reference numeral 24. From the marking engine at station 24, the sheet stock is advanced along path 22 and discharged from fuser 20 to an inverter 26 which inverts the marked sheet and maintains the sheet for a controlled dwell time before reentry onto path 22 and movement to the entrance station 28 for the second marking engine indicated generally at 30.

The sheet stock is controlled to arrive at the registration point indicated by the arrow and denoted by reference numeral 35 in marking engine 30 at a controlled time. The second marking engine 30 includes a P/R belt 32 and has colorant generators 34 for forming a color image on the P/R belt 32. It should be understood that the belts 16 and 32 include seams and that imaging on the seams of either belt is to be avoided to insure image quality. The P/R belt 32 is operative to transfer the color image to the second side of a sheet at a transfer station indicated by reference numeral 33. The marking engine 30 also includes a post marking fuser 36. The sheet is then conveyed to a second inverter 38 which restores the sheet to its original orientation and discharges the duplex marked sheet to a finisher 40.

The system of FIG. 1 includes a controller 50 connected as indicated by dashed lines in for controlling the marking engines 14 and 30, and the inverter 26. The controller 50 generally monitors the position of the seams of P/R belts 16 and 32 by means of any suitable sensor (not shown). For example, a hole in a P/R belt can be sensed to identify the location of the seam.

With reference to FIG. 2, illustrated in block 52, in accordance with the present disclosure, a suitable controller schedules media arrival times at engine 1 and engine 2. At block 54, there is illustrated the synchronization of the P/R belts of engine 1 and engine 2 such that the belt seams are relatively positioned for symmetrical printing, that is, the lead edge of first sheet intercepts panel 1 on both engine 1 and engine 2. Panel 1 is defined as the first panel following the photoreceptor belt seam in both engine 1 and engine 2. Block 56 demonstrates the operation of the feeder to eject a sheet to meet the engine 1 scheduled arrival time.

As shown in block 58, the sheet arrives at the entrance to engine 1 and at block 60, there is illustrated the sheet arriving at the engine 1 registration subsystem. Block 62 illustrates the step of registration of the sheet with the image to be transferred to the sheet. At this point, the relationship of the arrival of the sheet at the transfer station with respect to the arrival of the image on the belt must be within a +/−30 millisecond tolerance. At block 64, there is an illustration of the arrival of the sheet at the engine 1 transfer station for transfer of the image to the first side of a given sheet. It should be noted that at this point, the control system has positioned the photoreceptor belts of engines 1 and 2 in optimal position with respect to the image panels on the belts with respect to the belt seams.

At block 66, the sheet has been parked or temporarily delayed in the engine 1 sheet output inverter. Block 68 shows the step of ejecting the sheet from the output inverter for conveyance to engine 2 at the scheduled arrival time and block 70 illustrates the arrival of the sheet at the engine 2 entrance. In block 72, the sheet arrives at the engine 2 registration system and at block 74 the sheet is registered to the image on the engine 2 belt. As with engine 1, the sheet registration tolerance of engine 2 for receiving a belt image is preferably within plus or minus 30 milliseconds. At block 76, finally, there is illustrated the transfer of the image from belt 2 of engine 2 to the second side of the given sheet. It should be noted again, that, in a preferred embodiment, in accordance with the present disclosure, the sheet that receives an image from a panel on belt 2 on its second side is the same sheet that has received an image from an equivalent panel on belt 1 of engine 1 on its first side. That is, an image on belt 1 of engine 1 on the panel or portion of the belt immediately after the engine 1 belt seam will be transferred to a first side of a given sheet. The second side of the given sheet will then receive an image from the belt of engine 2. The image from belt 2 will be from a panel or portion of the belt immediately after the seam of belt 2. In a similar manner, the same sheet that receives an image from the second panel of belt 1 immediately after the belt seam of belt 1 of engine 1 on its first side will receive an image on its second side from the second panel of belt 2 immediately after the seam of belt 2 of engine 2. However, it should also be understood that there are other contemplated embodiments, such as defining differently numbered panels or panels differently spaced from respective seams as equivalent panels. Thus the panel frame of reference between the two belts need not be two panels of equal distance from the seams. Any two panels will work as reference panels if there is a consistency in the image transfer operation of pairs of images from each belt in relation to the reference panels.

It should also be apparent that while specific embodiments of the present disclosure have been illustrated and described, it will be understood by those having ordinary skill in the art to which this disclosure pertains, that changes can be made to those embodiments without departing from the spirit and scope of the disclosure. Further, the claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, or position.

What is claimed is:

1. A method of synchronizing image to print sheet operation in a digital printing system having first and second image marking engines with image bearing members with seams, each image bearing member having a set of image panels, comprising the steps of:

projecting a first image onto a given image panel of the first marking engine, projecting a second image onto a given image panel of the second marking engine, the given image panel of the first marking engine being equivalent to the given image panel of the second marking engine, the distance of the first image from the seam of the first marking engine being different than the distance of the of the second image from the seam of the second marking engine, transferring the first image to a first side of a print sheet, conveying the print sheet from the first marking engine to the second marking engine, and transferring the second image to the second side of the print sheet.

2. In a printing system having first and second printing engines, the engines including imaging belts with seams, each of the imaging belts allocating a predetermined number of image panels positioned around the belt circumference for receiving projected images, each image panel having a spaced relationship to the belt seam, a method of synchronizing the printing of images from the tandem printing engines on both sides of a print sheet comprising the steps of:

defining a first image panel of the first printing engine to receive a first image, the first image panel having a spaced relationship to the seam of the first printing engine, defining a second image panel of the second printing engine to receive a second image, the second image panel having an arbitrary spaced relationship to the seam of the second printing engine, projecting a first image onto the first image panel of the belt of the first engine, the first image having a predetermined relationship with the seam of the belt of the first engine, transferring the first image to a first side of a print sheet, projecting a second image onto the second image panel of the belt of the second engine, the second image having an arbitrary relationship with the seam of the belt of the second engine, the arbitrary relationship of the second image on the second panel with the seam of the belt of the second engine being synchronized with the predetermined relationship of the first image on the first panel with the seam of the belt of the first engine, whereby the second image on the second panel is transferred to the second side of the print sheet.

3. The method of claim 2 including the steps of selectively defining a first image panel in relation to the seam and other panels positioned around the belt circumference of the first printing engine to receive a first image and selectively defining a second image panel in relation to the seam and other panels positioned around the belt circumference of the second printing engine to receive a second image, the selected second image panel having a relationship to seam and other panels positioned around the belt circumference of the second printing engine different from the relationship of the first image panel to the seam and other panels positioned around the belt circumference of the first printing engine.

4. The method of claim 3 wherein the first image panel is the first panel after the seam of the belt of the first printing engine in the belt direction and the second image panel is the last image panel after the seam of the belt of the second printing engine in the belt direction.

5. In a printing system having first and second printing engines, the engines including imaging belts with seams, each of the imaging belts allocating a predetermined number of image panels positioned around the belt circumference for receiving projected images, each image panel having a spaced relationship to the belt seam, a method of synchronizing the printing of images from the tandem printing engines on both sides of a print sheet comprising the steps of:

providing a sheet for receiving transferred images on a first side and on a second side, projecting a first image on a first selected panel of the belt of the first printing engine, the first selected panel being a first given distance from the seam of the first printing engine, projecting a second image on a second selected panel of the belt of the second printing engine, the second selected panel being a second given distance from the seam of the second printing engine, positioning the lead edge of the sheet for receiving the first image from the first selected panel on a first side, temporarily delaying the sheet with the first image in a sheet inverter, and positioning the lead edge of the sheet with the first image for receiving the second image from the second selected panel of the belt of the second printing engine on a second side.

6. The method of claim 5 wherein the first selected panel of the belt of the first printing engine and the second selected panel of the belt of the second printing engine are arbitrarily selected panels.

* * * * *